United States Patent [19]

Padovani

[11] Patent Number: 4,726,489

[45] Date of Patent: Feb. 23, 1988

[54] YOGURT CONTAINER AND COVER THEREFOR

[75] Inventor: Pietro Padovani, Verona, Italy

[73] Assignee: I.S.A.P. SpA (Industrie Specializzate Articoli Plastici), Parona, Italy

[21] Appl. No.: 39,576

[22] Filed: Apr. 15, 1987

[30] Foreign Application Priority Data

Apr. 21, 1986 [IT] Italy ..... 84921 A/86
Sep. 30, 1986 [IT] Italy ..... 84949 A/86

[51] Int. Cl.[4] ..... B65D 39/00

[52] U.S. Cl. ..... 220/307; 220/257; 220/366

[58] Field of Search ..... 220/307, 357, 366; 150/55; 229/43

[56] References Cited

U.S. PATENT DOCUMENTS

| | | | |
|---|---|---|---|
| 2,985,354 | 5/1961 | Aldington | 220/307 |
| 3,344,974 | 10/1967 | Bostrom | 220/257 |
| 3,391,847 | 7/1968 | Christine et al. | 220/257 |
| 4,300,700 | 11/1981 | Chang | 220/257 |
| 4,555,043 | 11/1985 | Bernhardt | 220/257 |
| 4,679,699 | 7/1987 | Malsbury et al. | 220/307 |

*Primary Examiner*—George T. Hall
*Attorney, Agent, or Firm*—Ladas & Parry

[57] ABSTRACT

A yogurt container and a cover therefor obtained from a sheet of thermo-plastics material, wherein said container comprises a hollow frusto-conical body, radiused to a flat edge by means of at least an annular step-like-projection and by means of a side wall portion, and wherein said cover being nestable in the container above said body comprises a peripheral wall and a central handgrip. The side wall portion is formed of an upper part downwardly frusto-conical and of a lower cylindrical part. A plurality of recesses are provided inside the container in the region where said cylindrtical part and said frusto-conical part join together, each recess being formed of a base and of an upwardly tapered wall and being a spacer between stacked empty containers. The elastically yieldable peripheral wall of the cover is upwardly substantially frusto-conical and can be radially pressed in- and/or outwardly by means of at least an annular channel provided between the said peripheral wall and the handgrip and by means of the cylindrical part of said wall portion of the container to improve considerably the tightness between the cover and the container and to withstand inwards bending of the side wall of the container. According to another embodiment the side wall portion of the container comprises a back draft part, a projection, a cylindrical part and a downwardly frusto-conical part, while in another embodiment the peripheral wall of the cover is downwardly frustoconical and in its upper part is provided with a small flange. For an easy removal of the cover the side wall of the handgrip is of a downwardly frusto-conical shape and/or is provided with downwardly frusto-conical flutes tapering towards the axis of the cover for facilitating axial drafts on the cover and/or for imparting torsional movements to the cover around the axis thereof.

10 Claims, 12 Drawing Figures

YOGURT CONTAINER AND COVER THEREFOR

DESCRIPTION

The present invention relates to a yogurt container and cover therefor obtained from a sheet of thermoplastics material, and wherein a sealed packaging is obtained by welding a tin foil plate to the top portions of the cover and to the edge of the container.

It is known that containers of this type are filled with hot yogurt by machines which also provide for placing the cover thereon as well as for sealing of the packaging within a short period of time. As a result thereof a pressure drop takes place inside the container when the contents grow cool.

Accordingly, the container side wall has to be allowed to be easily bent inwards and this can cause a drawback for instance when the packaging is pell-mell stowed together with other items.

Furthermore, when the packaging is opened by breaking away the tin foil plate, another drawback is during the repeated manipulation of the container which, in the horizontal or in highly inclined position, allows the contents to come out, due to a lack of tightness between the cover and the container.

It is an object of the present invention to at least minimize said drawbacks.

Another object of the invention is to provide for the cover to be easily removed from the container notwithstanding a tight closure therebetween.

According to the present invention there is provided a yogurt container and cover therefor obtained from a sheet of theroplastics material, said container comprising a hollow frusto-conical body radiused to a flat edge by means of an annular step-like-projection and by means of a frusto-conical side wall portion said cover being nestable in said container above said body, in which an elastically yieldable peripheral wall of the cover is capable of being radially pressed in- and/or outwards of the axis of said cover by means of a cylindrical side wall portion provided in the container between a projection and a wall portion and by means of at least a channel provided between the said peripheral wall and the handgrip provided in said cover.

The advantages afforded by the invention are to be seen in the fact that the side wall of the container withstands inwards bending and in the fact that the tightness between the cover and the container is considerably improved.

A further advantage is to be seen in the easy removal of the cover.

The present invention will be further illustrated by way of example, with reference to the accompanying drawings, in which.

Figure 1:
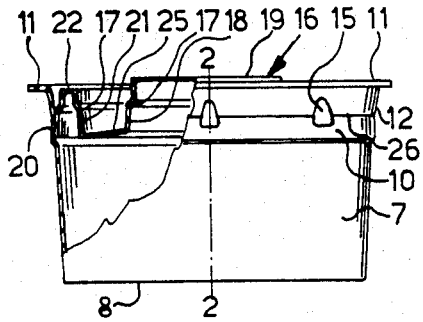
FIG. 1 is a front view of a container and of its cover partially broken away to show their cross sections.
Figure 7:
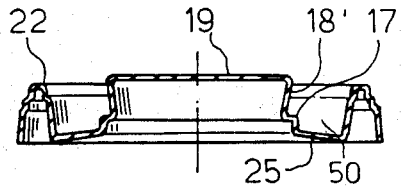
Figure 9:
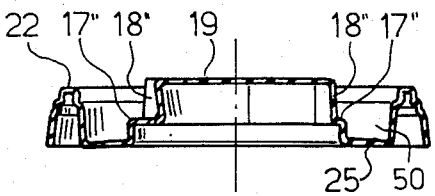
Figure 8:
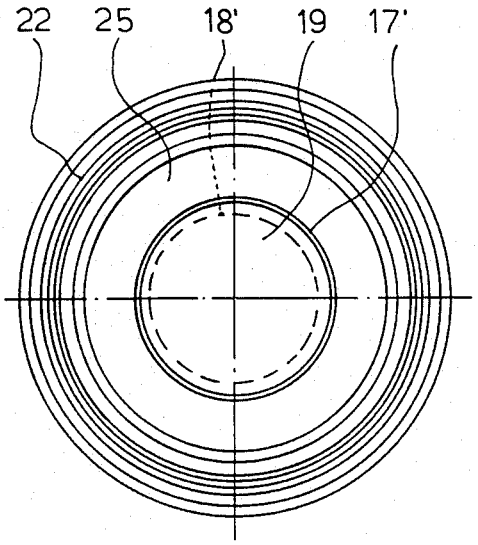
Figure 10:
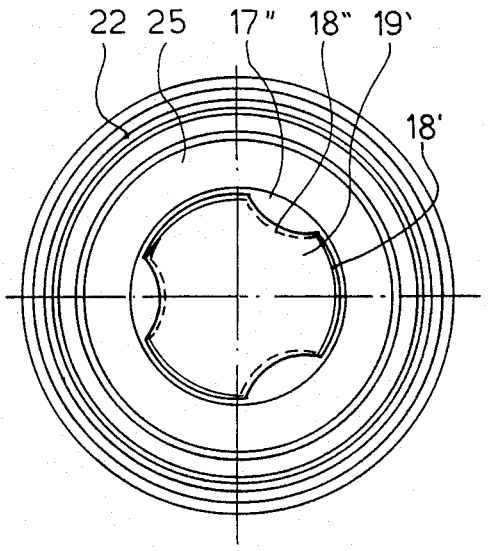
Figure 11:
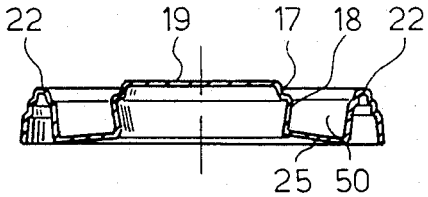
Figure 12:
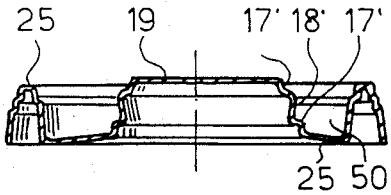

FIGS. 7 and 8 respectively show a section and a top view of the cover of FIG. 1, according to another embodiment of its handgrip;

FIGS. 9 and 10 are views similar to FIGS. 7 and 8, and show a further embodiment of the handgrip, and FIGS. 11 and 12 show the cross sections of two covers similar to that illustrated in FIGS. 7 and 8, but with further embodiments of the handgrip.

In the accompanying drawings, the figures are of various sizes and the same reference numerals are used to identify the same or equivalent integers. As illustrated in FIG. 1 it is to be noted that the frusto-conical hollow body 7 of the container has a circular bottom 8 and at its upper portion is provided with an annular step-like-projection 9 upon which rests the cover 16 when it is inserted. Said projection 9 extends upwards to the circular flat edge 11, by means of a cylindrical side wall portion 10 and a frusto-conical side wall portion 12.

A plurality of recesses 13 are formed on the inside face of the container in the region where the side wall portions 10 and 12 join together along the circumference 26, which indicates the insersection of the side wall portions 10 and 12. The recess 13 are disposed at intervals and each recess has a base 14 below the circumference 26 and an upwardly tapering wall 15 ending above said circumference 26.

Figure 2:
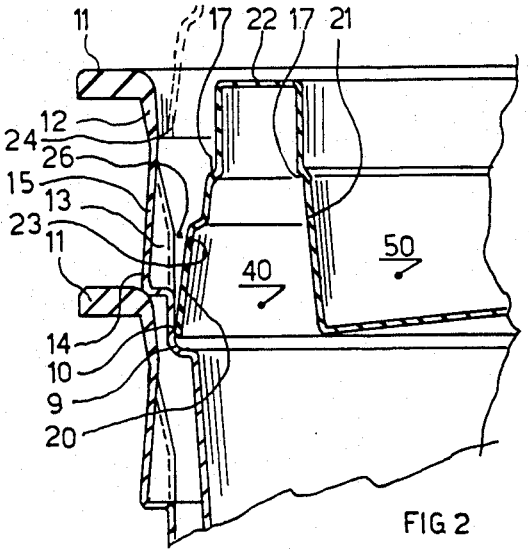
FIG. 2 is a partial cross section, taken along the line 2—2 of FIG. 1, of a container stacked in an underlying container.

As it may be seen in FIG. 2, when the empty containers are stacked, the recesses 13 of each container rest on the edge 11 of the underlying container preventing them from jamming together. This feature permits a good mechanical feeding of the containers to the operating machines which will fill the containers with hot yogurt, position the covers and seal the packagings.

For the same purpose, the cover 16 is provided with toroidal ridges 17 on its central and peripheral portions in order to prevent them from jamming together, while being stacked, thus avoiding problems in the mechanical feeding.

The central portion of the inserted cover 16 is formed of a hollow frusto-conical handgrip with a side wall 18 and a top wall 19 which slightly projects above the edge 11 of the container.

The peripheral region of the cover 16 is formed of two circular walls 20 and 21 which converge towards the upper wall 22. The outside wall 20 is provided with a ridge 23 which strengthens said wall in cooperation with the ridge 17. The lower portion of the wall 20 has a diametral distance which is longer than that of the circumference 26.

Between the wall 20 and the handgrip 18, 19 of the cover there are two circular channels 40 and 50 which have a common wall 21, the first being open downwardly and the second upwardly. The channel 50 has a frusto-conical bottom 25 converging upwardly in the direction of the axis of the cover.

Once the body 7 has been filled with hot yogurt, the cover is brought into the mouth of the container, (see the outlined position of the cover in FIG. 2). When the lower portion 24 of the wall 20 contacts the frusto-conical side wall portion 12 it is radially compressed inwards as far as the cover is lowered and forced within the cylindrical side wall portion 10.

During such operation, the air inside the container is pressed by the cover 16 and passes out through the recesses 13 operating as breathers, until the lower portion 24 of the wall 20 contacts the round edges of the bases 14 of the recesses 13. From that moment until when said lower portion 24 reaches the projection 9, an overpressure will originate inside the container.

After the cover 16 has been completely located, the machine provides for sealing the packaging by welding a tin foil plate, not illustrated in the drawings, onto the handgrip top wall 19 and the flat edge 11 of the container. In the course of said operation, the pressure exerted onto the handgrip top wall 19 will force the bottom 25 of the channel 50 into a substantially horizontal position, and thereby to compress the walls 21 and 20 radially outwardly.

Consequently, the tightness between the cover and the container will increase but in the same time the overpressure within the container will also increase.

It is clear to one skilled in the art, that the overpressure inside the container may be so high as to counterbalance the depression which will take place by cooling of the contents, so that the container side wall will withstand inwards bendings.

From what has been previously stated, it is clear that, according to needs, the distance between the projection 9 and the base 14 of the recesses 13 may be lengthned with the aim, for istance, of obtaining a light overpressure inside the container after the contents have cooled.

Furthermore, once the packaging has been opened by breaking away the tin foil plate, it will be possible to remove and replace the cover again, being certain that the latter will have a very good tightness, also should the container be inclined even to a horizontal position.

Practical tests have shown the containers can even be turned over, without permitting the contents to pass out.

Clearly the contents and the frusto-conical upwardly deverging shape of the hollow body 7 are not essential to attain the scope of the invention. The circular bottom portion 8 may be of whatever poligonal shape, for instance having rounded corners, whilst the side walls may be flared upwardly to end in a circular flat edge 11.

Figure 4:
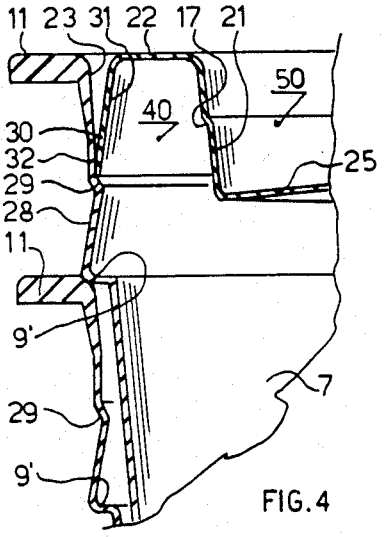
FIGS. 3 and 4, are views similar to FIGS. 1 and 2 and show a second embodiment.
Figure 3:
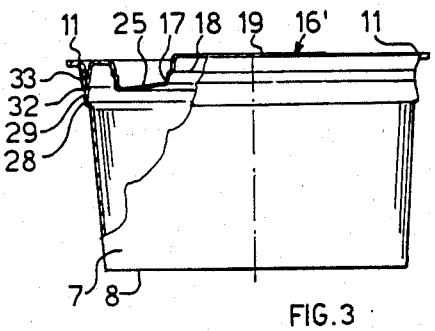

Having regard to FIGS. 3 and 4 it will be noted that containers and covers therein are of the frusto-conical type similar to those illustrated in FIGS. 1 and 2.

The container hollow body 7 has a bottom 8 and in its upper portion is provided with a circular step-like-projection 9 which, as it may be seen in FIG. 4, is a distancing or spacing element between the empty stacked containers. The projection 9' is radiused to the edge 11 with side wall portions of particular configuration the portion 28 extends in back draft and with an outwards bending forms a circular projection 29; a substantially cylindrical portion 32 extends upwardly therefrom to and in a frusto-conical flared portion 33.

The circular projection 29, see FIG. 4, is a ledge seat for the lower end 30 of the peripheral wall 31 of the cover 16', said wall having a rectilinear generatrix.

After having filled the container with hot yogurt, the inserting of the cover causes an overpressure inside the container due to the tightness between the container and the cover. The diametral measure of the lower part 30 of the peripheral wall 31 of the cover 16' is greater than that of the cylindrical side wall portion 32.

Also in this embodiment, as well as in the embodiment described in connection with FIGS. 1 and 2, the overpressure will compensate the depression arising in the container during the cooling of the contents and, likewise, it is possible to obtain a light overpressure inside the container after the contents have cooled.

Figure 5:
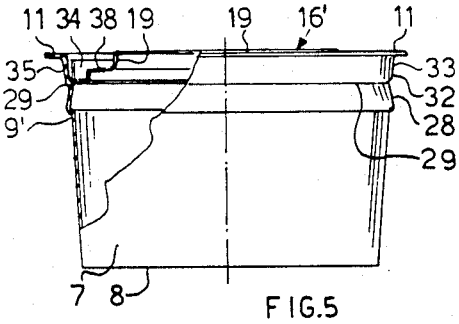
FIGS. 5 and 6, are views similar to FIGS. 1 and 2 and show a third embodiment.
Figure 6:
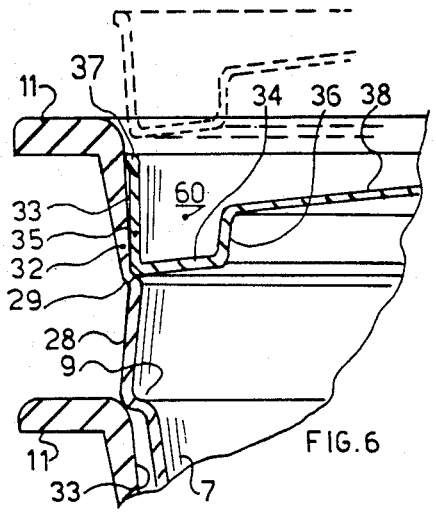

With reference to FIGS. 5 and 6, there is to be noted that only some portions of the cover 16'' differ from those shown in FIGS. 3 and 4, whilst the container is identical to that of FIGS. 3 and 4.

In the peripheral region of the cover 16'' there is a circular channel 60 having a bottom 34 and having conical upwardly diverging side walls of which the peripheral one 35 has a heigth nearly double if it is compared to that of the internal wall 36, and ends outwordly with a small flange 37.

The upper part of the wall 36 extends to the handgrip 18-19 of the cover 16'' with an upwardly converging frusto-conical wall 38.

The diametral measure of the lower part of the wall 35 is longer than the diametral measure of the wall portion 32, whilst the maximal diametral measure of the wall portion 33 is shorter than the maximal diametral measure of the flange 37. Consequently the seating in of the cover 16'' involves radial pressure on the exterior face of the wall 35, which will carry out a desired tightness by means of its lower portion and its flange 37, that is to say in two planes spaced apart.

The balance of the depression that will arise inside the container at the cooling of the contents, in this embodiment takes place in a way substantially equal to that which happens in respect of the containers illustrated in FIGS. 3 and 4.

Nevertheless, the upwardly frusto-conical shape of the peripheral wall of the cover considerably enables the manual seating in of the cover.

The teaching arising from what has been stated in respect of the cover of FIGS. 5 and 6 allows one skilled in the art, without involving inventive operation to achive the embodiment of a container such as that shown in FIGS. 1 and 2, and of a cover similar to that of FIGS. 5 and 6.

It is clear that stiffening radial ribs may be provided on the bottom 25 of the channel 50 and on the frusto-conical wall 38, respectively of the covers 16, 16' and 16''.

From what has been said, it is evident that the peripheral wall of each one of the covers 16, 16', 16'', is elastically yieldable and radially pressable towards the inside or outside of the container due to one or more annular channels located between said peripheral wall and the central handgrip 18, 19 of the cover, said channels being open up- and/or downwardly.

In FIGS. 7, 8, 11, 12, there is to be noted that the handgrip of the cover 16 is different from that shown in FIG. 1, since the handgrip side wall 18' which connects the circular top wall 19 to the bottom 25 of the channel 50 is downwardly frusto-conical.

In FIGS. 7 and 8 the said wall 18' is radiused to the bottom 25 of the channel 50 by means of an annular step-like-projection 17' forming a seat housing of the cover onto the handgrip top wall of a cover placed underneath.

It is evident that a user of a container provided with such a cover will clutch the handgrip side wall 18' by means of his finger tips. The said side wall, thanks to its downwardly converging concavity allows a steady hold and an axial draft on the cover so that the removal thereof is very easy.

During the clutching of the handgrip, the user presses the lower portion of the wall 18' concentrically in such a way that the outward radial pressure of the peripheral wall of the cover is lowered so that the removal thereof is further facilitated.

In FIG. 11, the frusto-conical side wall 18' of the handgrip is radiused to the handgrip top wall by means of an inside step-like-projection 17'' which forms a housing seat to the bottom 25 of the channel 50 of a cover placed thereover.

In FIG. 12, it is to be noted that the frusto-conical side wall 18' of the handgrip shows both the step-like-projections 17',17 respectively illustrated in FIGS. 7 and 11.

It is clear that the functionality of the handgrips of the covers illustrated in FIGS. 11 and 12, as concerns the removal of the cover nested in container is entirely identical to that described in respect of the cover shown in FIGS. 7 and 8.

With reference to FIGS. 9 and 10 it is to be observed that the handgrip 17'''-18''-18'''-19' comprises a top wall 19' which is delimited by three arcs of a circumference spaced by means of three arc-indentations, a side wall formed of three down- and outwardly frusto-conical sectors 18'', spaced by means of flutes 18''' converging towards the axis of the cover, said sectors and said flutes being radiused to the bottom 25 of the channel 50 with an annular step-like-projection 17'''. Said step-like-projection 17''' forms a housing seat of the cover to be superimposed to the top wall of an identical cover placed underneath. The flutes 18''' enable the clutch of the handgrip by the finger tips of the thumb, forefinger and middle finger of a hand of a user. Said device allows the user to impact to the cover housed on a container also a torsional movement around the axis thereof, thus further facilitating removal of the cover.

Although not illustrated in the drawings,it is evident that the handgrips described in connection with FIGS. 7–12 may be carried out also in the covers 16' and 16'' previously described.

I claim:

1. A yogurt container and cover therefor obtained from a sheet of thermoplastic material, said container comprising:

a hollow generally frusto conical body (7–8) radiused to a flat edge (11) by means of an annular, step-like projection (9,9') defined in the frustoconical side wall portion (12, 28-29-33);

a cylindrical side wall portion (10, 32) adjacent said step-like projection and projecting toward said flat edge (11);

a wall portion joining said flat edge (11) and said cylindrical side wall portion (10, 32);

said cover having a top portion defining a handle thereon (19); an outermost peripheral wall (20, 21) which extends from said top portion and is nestable in said continaer above said body, said peripheral wall being elastically yieldable and capable of being radially pressed inwardly and outwardly of the axis of said cover by means of said cylindrical side wall portion (10, 32) and defining in its surface at least one channel (40, 50, 60) for further flexibility.

2. A yogurt container and cover therefor as claimed in claim 1, in which the channel (40) of the cover (16) is downwardly open; the channel (50) is upwardly open; the wall (21) is common to both said channels and the end portion (24) of the wall (20) has a distance from the axis of the cover longer than that of the wall portion (10) from the axis of the hollow body (7).

3. A yogurt container and cover therefor as claimed in claim 1, in which a plurality of recesses (13) at intervals are provided on the inside face of the container in the region where the side walls (10) and (12) join together, each recess being formed of a base (14) and of an upwards tapered wall (15) and being a spacer between stacked empty containers.

4. A yogurt container and cover therefor as claimed in claim 1, in which the channel (40) of the cover (16') is downwardly open; the channel (50) is upwardly open; the wall (21) is common to both channels and the lower end (30) of the wall (31) has a distance from the axis of the cover longer than that of the wall portion (32) from the axis of the hollow (7).

5. A yogurt container and cover therefor as claimed in claim 1, wherein the wall (31) of the cover (16') has a rectilinear generatrix.

6. A yogurt container and cover therefor as claimed in claim 1, in which the channel (60) of the cover (16'') is upwardly open; the flanged end (37) of the wall (35) has a distance from the axis of the cover longer than that of the lower portion of the wall (33) from the axis of the hollow body (7), and wherein the wall portion (32) has a distance from the axis of the hollow body (7) shorter than that of the lower end of the wall (35) from the axis of the cover.

7. A yogurt container and cover therefor as claimed in claim 1, in which the handgrip (17'-18'-19) comprises a circular top wall portion (18), a frusto-conical downwardly tapering wall (18') radiused to the bottom (25) of the channel (50) by means of a step-like-projection (17').

8. A yogurt container and cover therefor as claimed in claim 1, in which the handgrip (17''-18'-19) comprises a downwardly frusto-conical side wall (18') radiused to a circular top wall (19) by an inwardly annular step-like-projection (17'').

9. A yogurt container and cover therefor as claimed in claim 1, in which the handgrip (17'-17''-18'- 19) comprises a downwardly frusto-conical side wall (18') radiused to the bottom (25) of the channel (50) by an outwardly annular step-like-projection (17') and to the top wall (19) by an inwardly annular step-like-projection (17'').

10. A yogurt container and cover therefor as claimed in claim 1, in which the handgrip (17'''-18''-18'''-19') comprises a top wall (19'), the contour of which is formed by three arcs of a circumference spaced by means of three arc-indentations, a side wall formed of three upwardly frusto-conical portions (18'') spaced by three downwardly frusto-conical flutes (18'') tapering towards the axis of said cover, said portions and said flutes being radiused to the bottom (25) of the channel (50) by an annular step-like-projection (17''').

* * * * *